United States Patent [19]

Mikiya

[11] Patent Number: 5,031,256

[45] Date of Patent: Jul. 16, 1991

[54] JET NOZZLE ATTACHMENT

[75] Inventor: Toshio Mikiya, Tokyo, Japan

[73] Assignee: Nikki Co., Ltd., Tokyo, Japan

[21] Appl. No.: 407,370

[22] Filed: Sep. 14, 1989

[30] Foreign Application Priority Data

Sep. 19, 1988 [JP] Japan ..... 63-122507[U]

[51] Int. Cl.[5] ..... A61H 3/08; E04H 4/00

[52] U.S. Cl. ..... 4/542; 4/492; 4/496

[58] Field of Search ..... 239/407, 428, 401, 405, 239/413, 414, 419.5, 447, 381, 428.5, 391; 128/66; 4/494, 541, 542, 544, 492, 496, 507, 546, 552, 559, 567, 568; 285/92

[56] References Cited

U.S. PATENT DOCUMENTS

| | | | |
|---|---|---|---|
| 2,447,123 | 8/1948 | Jones | 128/66 |
| 3,471,091 | 9/1967 | Baker | 239/416 |
| 3,509,584 | 5/1970 | Sable | 4/494 |
| 3,614,952 | 10/1971 | Agnellino | 4/544 |
| 4,458,676 | 7/1984 | Pileggi | 128/66 |
| 4,703,893 | 11/1987 | Gruber | 239/391 |
| 4,933,999 | 6/1990 | Mikiya et al. | 4/542 |

*Primary Examiner*—Henry J. Recla
*Assistant Examiner*—David J. Walczak
*Attorney, Agent, or Firm*—Nixon & Vanderhye

[57] ABSTRACT

A jet nozzle attachment includes a hose having a connecting member to be connected to a compressed hot water jet hole formed inside a bath, and a nozzle, connected to the hose, for forcibly jetting out a fluid mixture of hot water and air. A fluid mixture of hot water and air can be jetted out in an arbitrary direction by using the nozzle.

8 Claims, 10 Drawing Sheets

JET NOZZLE ATTACHMENT

BACKGROUND OF THE INVENTION

1. Field of the Invention

The present invention relates to a jet nozzle attachment for massage used in a home bath.

2. Description of the Related Art

In conventional bath jet massage apparatus, generally, a jet hole for a jet stream is formed in the inner wall of a bath, and a fluid mixture of hot water and air is supplied to the jet hole using a pump so as to jet out the mixture from the jet hole into the bath as a jet stream.

In the conventional jet massage apparatuses, however, since the direction of a jet stream is fixed in one direction, a jet massage cannot be provided to every portion of a user's body in accordance with a wish of the user.

SUMMARY OF THE INVENTION

It is an object of the present invention to provide a jet nozzle attachment which allows a jet stream to freely massage any portion of a user's body in accordance with a wish of the user.

In order to achieve the above object, according to the present invention, there is provided a jet nozzle attachment comprising a hose having a connecting member to be connected to a compressed hot water jet hole formed inside a bath, and a nozzle, connected to the hose, for jetting out a fluid mixture of hot water and air.

According to the present invention, a hose with a nozzle is connected to a jet hole for, e.g., compressed hot water which is formed inside or outside a bath. Compressed hot water jetting out from the jet hole is introduced to the nozzle through the hose, and air is mixed with the hot water in the nozzle by an ejector effect. The fluid mixture of the hot water and the air is then jetted out from the nozzle. A user holds the nozzle with his/her hand and directs the jet stream, i.e., the fluid mixture of hot water and air to a desired portion of his/her body, thereby obtaining a massage effect. In addition, a fluid mixture of hot water and air which is formed beforehand may be jetted out from the jet hole. Alternatively, air may be mixed with hot water immediately before the hot water jets out so as to jet out the fluid mixture of the hot water and the air from the jet hole. In either case, a massage effect can be obtained by jetting out a strong jet stream from the nozzle. Moreover, since the hose having the nozzle at its end can be detached from the jet hole for compressed hot water, a massage effect by a jet stream can be obtained while the hose is detached from the jet hole.

According to the present invention, since a jet hole in a nozzle frame and a jet hole for a jet stream formed in the bath inner wall communicate with each other through the hose, a user can hold a nozzle body with his/her hand and arbitrarily direct a jet stream to any desired portion of his/her body, thus enabling effective massage of a desired portion of the body.

BRIEF DESCRIPTION OF THE DRAWINGS

FIGS. 1 to 9 show a jet nozzle attachment according to a first embodiment of the present invention, in which:

FIG. 1 is a longitudinal sectional side view showing a nozzle body constituting the jet nozzle attachment of the first embodiment;

FIG. 2 is a sectional right side view of the nozzle body in FIG. 1;

FIG. 3 is a sectional plan view of the nozzle body in FIG. 1;

FIG. 4 is a front view showing a jet surface of the nozzle body;

FIGS. 5 to 8 are sectional views showing various arrangements of connecting portions for connecting a hose, which is connected to the nozzle body, to a jet hole for a jet stream formed in a bath inner wall;

FIG. 9 is a view showing a case wherein the nozzle body of the first embodiment is attached to the bath inner wall;

FIGS. 10 to 16 show a second embodiment of the present invention; in which FIG. 10 is a longitudinal sectional side view showing a nozzle body constituting a jet nozzle attachment of the second embodiment;

FIG. 11 is a sectional right side view of the nozzle body in FIG. 10;

FIG. 12 is a sectional plan view of the nozzle body in FIG. 10;

FIG. 13 is a view showing a state wherein the jet nozzle attachment of the second embodiment is used;

FIG. 14 is a sectional view showing a main part of a float for introducing air in detail;

FIG. 15 is a sectional view showing another arrangement of an air adjusting means formed in the float; and FIG. 16 is a view for explaining a function of the air adjusting means in FIG. 15.

DETAILED DESCRIPTION OF THE PREFERRED EMBODIMENTS

Figure 1:
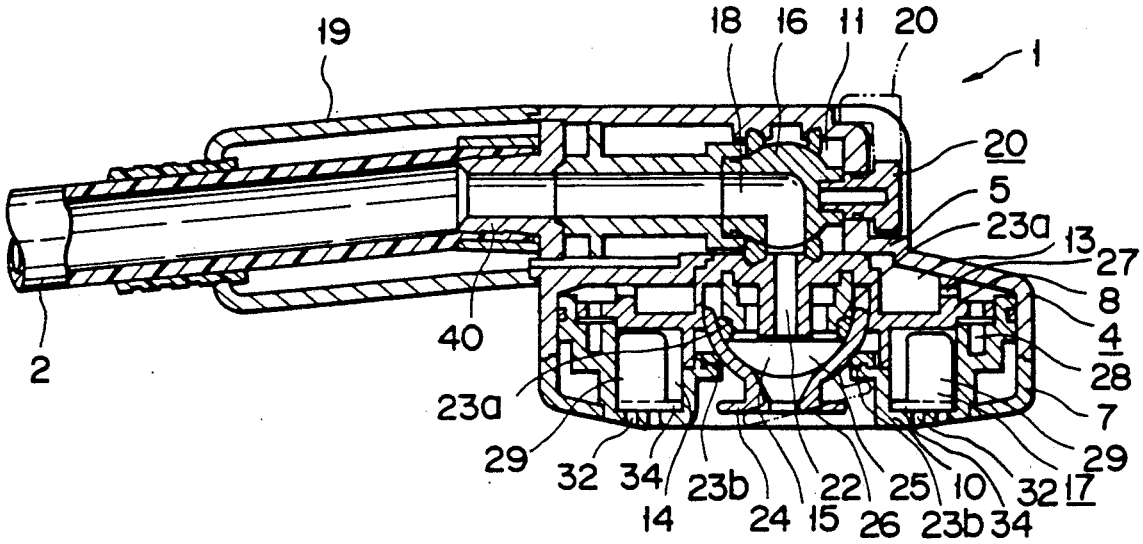
Figure 2:
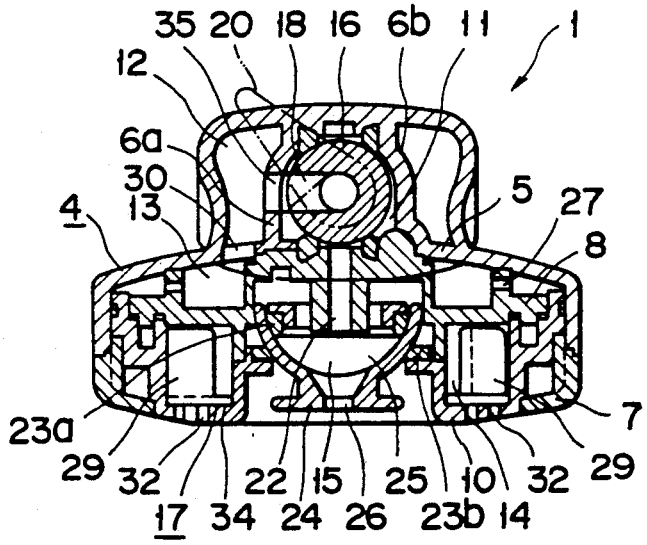
Figure 3:
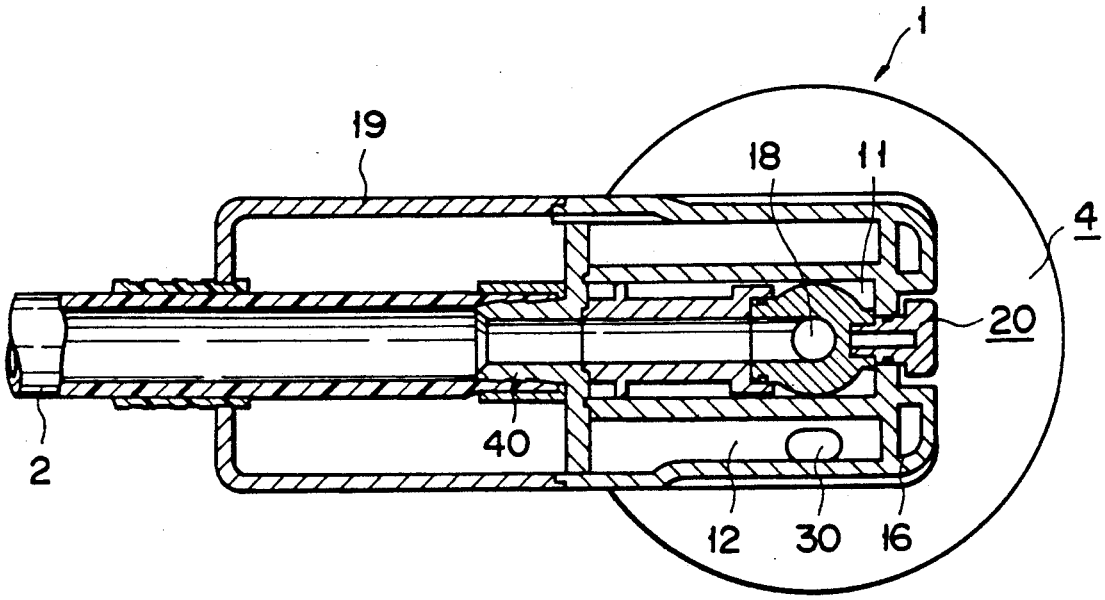
Figure 4:
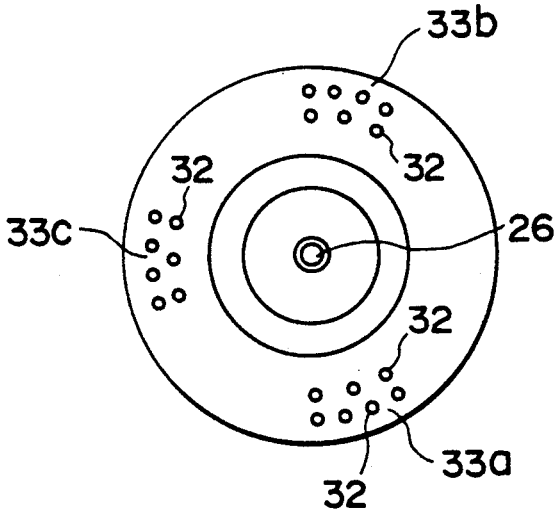

Embodiments of the present invention will be described below with reference to the accompanying drawings.

FIGS. 1 to 9 show a jet nozzle attachment according to a first embodiment of the present invention. The jet nozzle attachment of the present invention comprises a nozzle body 1 and a hose 2 as main constituent elements. One end of the hose 2 is connected to the nozzle body 1. A connecting portion 3 which is connected to a hot water jet hole formed in the inner wall of a bath is arranged at the other end of the hose 2.

FIGS. 1 to 4 show an arrangement of the nozzle body 1. In a nozzle case 4, an intermediate partition wall 5, side partition walls 6*a* and 6*b*, a frame 7, a first partition wall 8 interposed between the wall 5 and the frame 7, and a second partition wall 10 constitute a valve chamber 11, a path space 12, a hot water inlet chamber 13, an impeller chamber 14, and an open space 15. A switching valve 16 is housed in the valve chamber 11. An impeller 17 is rotatably housed in the impeller chamber 14. A switching path 18 having a substantially L-shaped section i formed inside the switching valve 16. In addition, a switching lever 20 for switching the flow of a fluid is coupled to the switching valve 16. A flow path 22 is formed in substantially the center of the first partition wall. The outlet side of the flow path 22 is covered with a bowl-like valve nozzle 24 slidably clamped between clamp portions 23*a* and 23*b*. A space defined between the valve nozzle 24 and the flow path 22 serves as a jet stream chamber 25. A jet hole 26 is formed in the central portion of the valve nozzle 24.

The impeller chamber 1 communicates with the path space 12 through paths 27 and 28 and a through hole 30. The impeller 17 housed in the impeller chamber comprises a plurality of vanes 29 (three vanes in this embodiment). Shield plates 34 are respectively fixed to two of these vanes 29. The shield plates 34 seal shower jet hole groups 33*a*, 33*b*, and 33*c* (FIG. 4) at positions where the shield plates 34 oppose the shower jet hole groups when the impeller 17 is rotated. The hole group 33*a*, 33*b*, or 33*c* consists of a plurality of shower jet holes 32 formed in a surface of the second partition wall 10, i.e., a wall portion formed on the nozzle jet surface side.

FIG. 1 shows a state wherein the outlet of the switching path 18 coincides with the flow path 22. In this state, a fluid mixture of hot water and air supplied from the hose 2 passes through the flow path 22 and enters the jet stream chamber 25. The fluid mixture then jets out from the jet hole 26 as a jet stream. If the switching lever 20 is operated to match the outlet of the switching path 18 with a valve hole 35, the fluid mixture jets into the impeller chamber 14 through the path space 12, the through hole 30, and the paths 27 and 28, and this jet stream strikes against the vanes 29 to rotate the impeller 17. As the impeller 17 is rotated, the shield plates 34 sequentially seal the shower jet hole groups 33*a*, 33*b*, and 33*c*. When the shield plates 34 seal the hole groups 33*a* and 33*b*, shower jet streams jet out from the remaining hole group 33*c*. When the impeller 17 is further rotated and the shower jet hole groups 33*b* and 33*c* are sealed by the shield plates 34, shower jet streams jet out from the hole group 33*a*. In this manner, intermittent shower jet streams orderly jet out from the shower jet hole groups 33*a*, 33*b*, and 33*c* upon rotation of the impeller 17.

Figure 9:
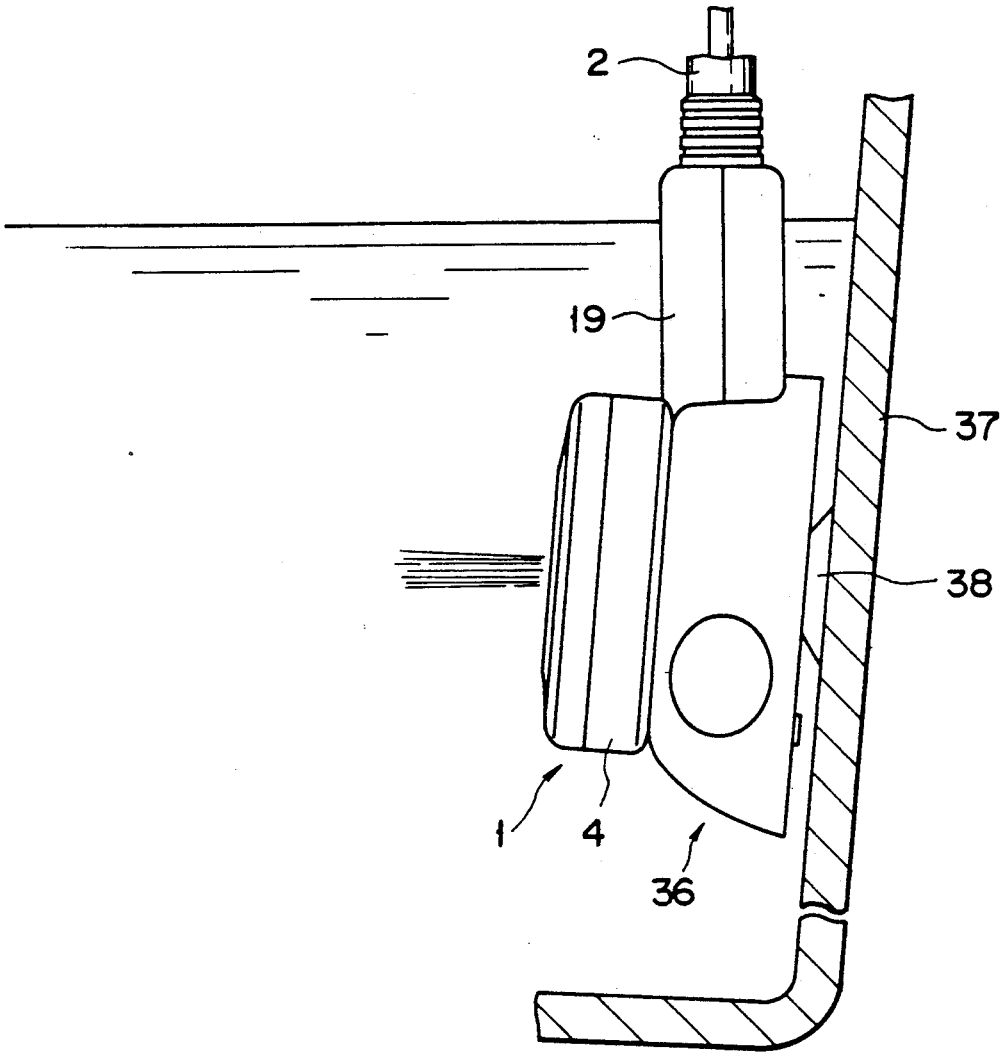
Figure 10:
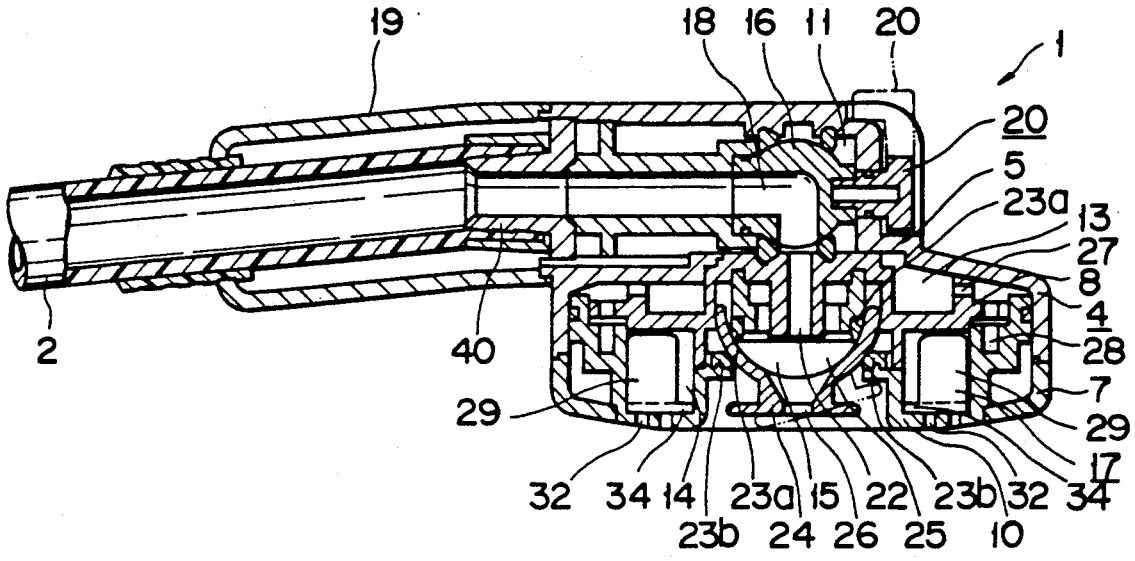
Figure 11:
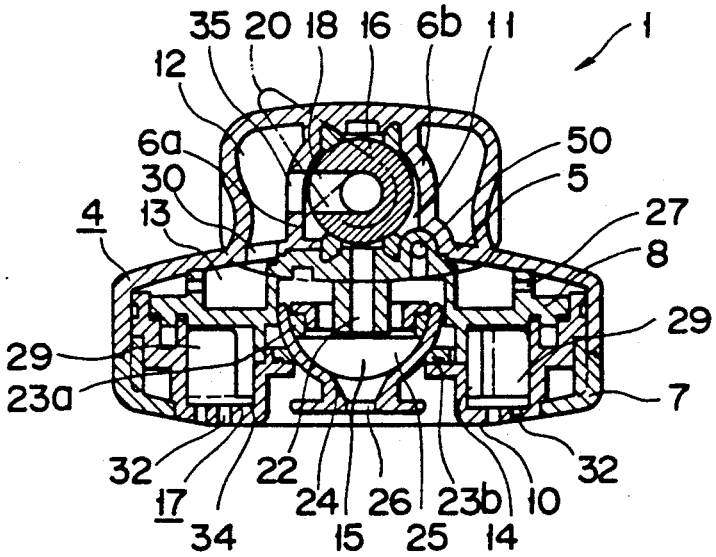
Figure 12:
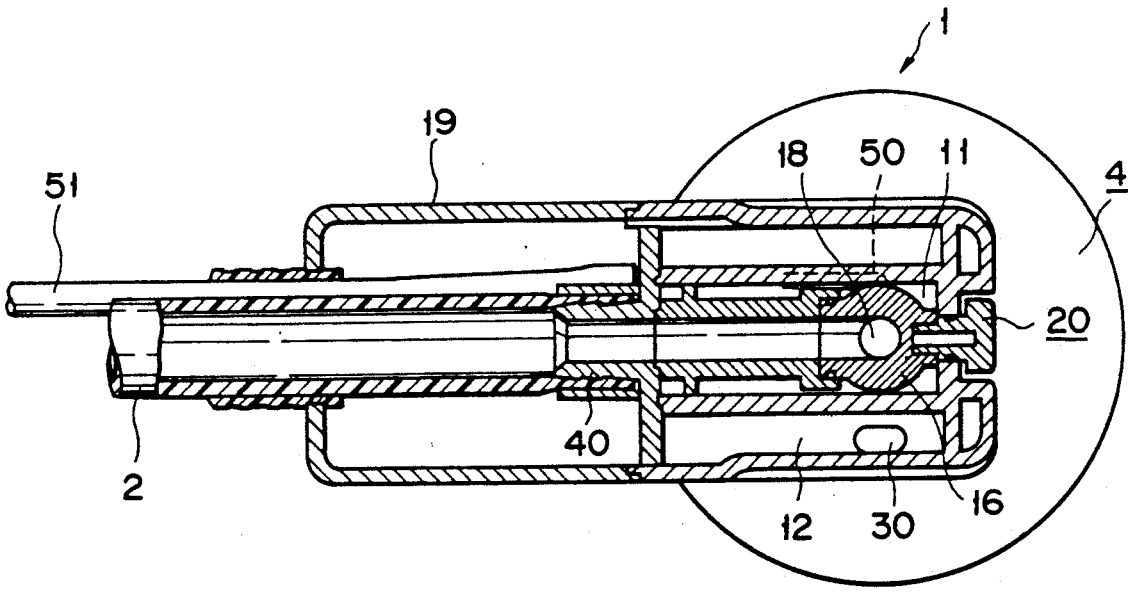

The nozzle body 1 having the above-described arrangement can be fixed in a bath 37 by using a holder 36 with a suction disk 38 which is immersed and fixed in hot water in the bath 37, as shown in FIG. 9, or by mounting a suction disk on the rear surface of the nozzle case 4 of the nozzle body 1 and fixing the nozzle body 1 to the bath inner wall by the suction disk.

One end of the hose 2 is connected to a connecting portion 40 of the nozzle body 1, and the connection portion 3 (to be described below) is formed on the other end of the hose 2.

Figure 5:
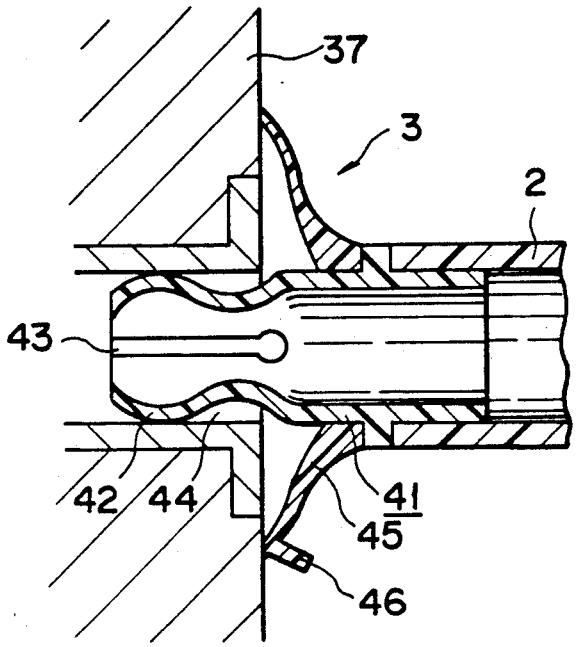

FIG. 5 shows a structure of the connecting portion 3. The proximal end of an insertion guide 41 is fitted in the other end of the hose 2. The insertion guide 41 is made of rubber or an elastic synthetic resin material. A guide cylindrical wall 42 having a corrugated section extends from the distal end of the insertion guide 41. A slit 43 is formed in the guide cylindrical wall 42 so as to extend in its longitudinal direction. The slit 43 allows easy bending of the guide cylindrical wall 42. The outer diameter of each of the end portion and a small-diameter portion of the guide cylindrical wall 42 is set to be smaller than the inner diameter of a jet hole 44 for a jet stream which is formed in the bath 37. The outer diameter of a large-diameter portion of the corrugated guide cylindrical wall 42 is set to be larger than the inner diameter of the jet hole 44. In addition, a suction disk 45 is fixed to the guide cylindrical wall 42. With this arrangement, the guide cylindrical wall 42 is inserted in the jet hole 44 while the large-diameter portion of the cylindrical wall 42 radially contracts. The cylindrical wall 42 is held by the elastic restoration force of this contracted portion. Furthermore, since the suction disk 45 is urged against the inner wall of the bath 3 when the cylindrical wall 42 is inserted in the jet hole 44, the hose 2 is fixed to the inner wall of the bath 37 by the suction force of the suction disk 45. Referring to FIG. 5, a grip portion 46 extending backward from the periphery of the suction disk 45 serves as an operating portion for removing the suction disk 45.

When the jet hole 44 is connected to the hose 2 in this manner, a jet stream, i.e., a fluid mixture of hot water and air, jetting out from the jet hole 44 is supplied to the nozzle body 1 through the hose 2. By switching the switching lever 20, desired jet streams or a stream can be selectively jetted out from the jet holes 32 or the jet hole 26 as intermittent shower jet streams or a jet stream. Note that when a jet stream is selected, the nozzle body 1 is used while it is immersed in hot water in the bath. When intermittent shower jet streams are selected, the nozzle body 1 is held by a user's hand and is used outside hot water in the bath.

Figure 6:
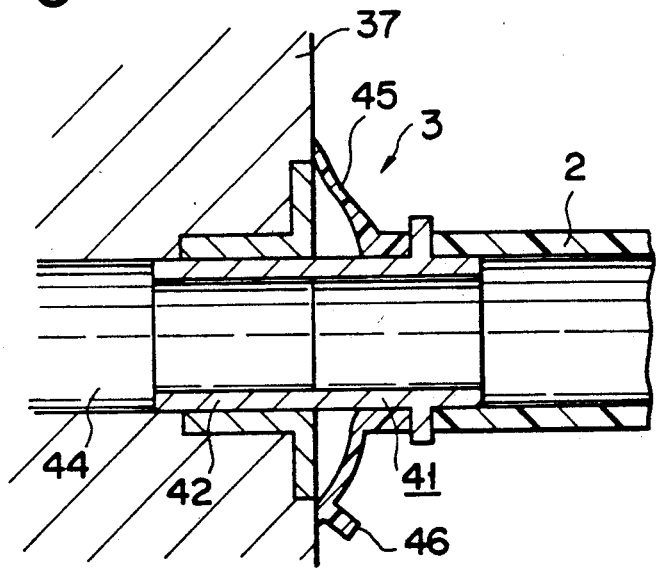
Figure 7:
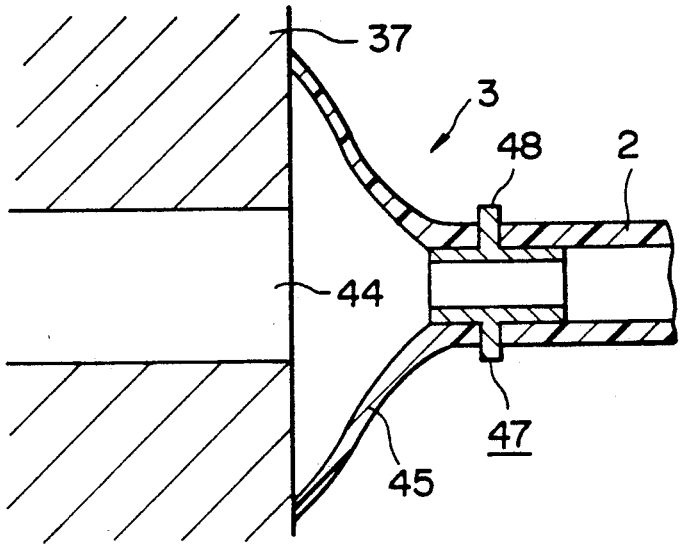
Figure 8:
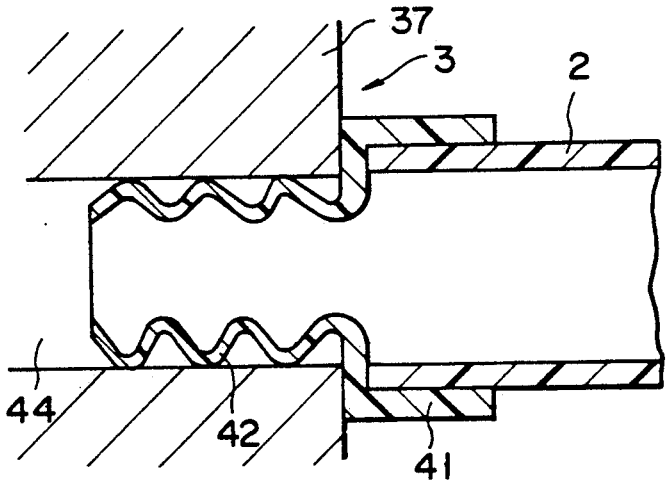

In addition to the structure of the connection portion 3 shown in FIG. 5, various structures as shown in FIGS. 6 to 8 are employed.

FIG. 6 shows a connecting portion 3 having a straight guide cylindrical wall 42 of an insertion guide 41 to be fitted in a hose 2. In this case, when the hose 2 is to be connected to a jet hole 44 of a bath 37, the guide cylindrical wall 42 as a guide is inserted in the jet hole 44, and a suction disk 45 is fixed to the bath inner wall with suction. FIG. 7 shows a connecting portion 3 which is designed such that a hose 2 is fitted on one end of a coupling sleeve 47 having a collar 48, and a suction disk 45 is fitted and fixed on the other end of the sleeve 47. In this case, since the connecting portion 3 has no guide portion to be inserted in a jet hole 44, and the suction disk 45 is fixed to the bath inner wall by suction while the central portion of the suction disk 45 is matched with the jet hole 44, the connecting portion 3 must be carefully attached so as to match the center of the hose 2 with that of the jet hole 44. In addition, FIG. 8 shows a connecting portion 3 which is designed such that the distal end portion of an insertion guide 41 is constituted by a cylindrical wall 42 having a corrugated section, and a hose 2 is fitted in the proximal end portion of the guide cylindrical wall 42. In this case, the corrugated guide cylindrical wall 42 is inserted in jet hole 44 in a contracted state, and the guide cylindrical wall 42 is fitted in the jet hole 44 in an urged state using the elastic restoration force of the wall 42 due to its contraction, thus connecting the hose 2 to the jet hole 44 so as not to be easily disconnected.

Note that since the jet nozzle attachment of the present invention is used while it is detachably connected to a jet hole for compressed hot water, the pressure of a compressed fluid always acts on the attachment while it is used. Therefore, the attachment should not be easily disconnected from a hot water jet hole by the pressure of hot water. In order to improve a disconnection preventing effect, a split ring which radially expands is preferably arranged in the insertion guide cylindrical wall 42, or the length of the insertion guide cylindrical wall 42 is preferably set to be long. In the structure shown in FIG. 7, however, such an effect is obtained by the suction disk 45 having a large suction force.

By connecting the hose 2 to the jet hole 44 in the above-described manner, a fluid mixture of hot water and air can be jetted out from the nozzle body 1 through the hose 2.

FIGS. 10 to 14 show a jet nozzle attachment according to a second embodiment of the present invention.

The same reference numerals in the second embodiment denote the same parts as in the first embodiment, and a description thereof will be omitted.

Figure 13:
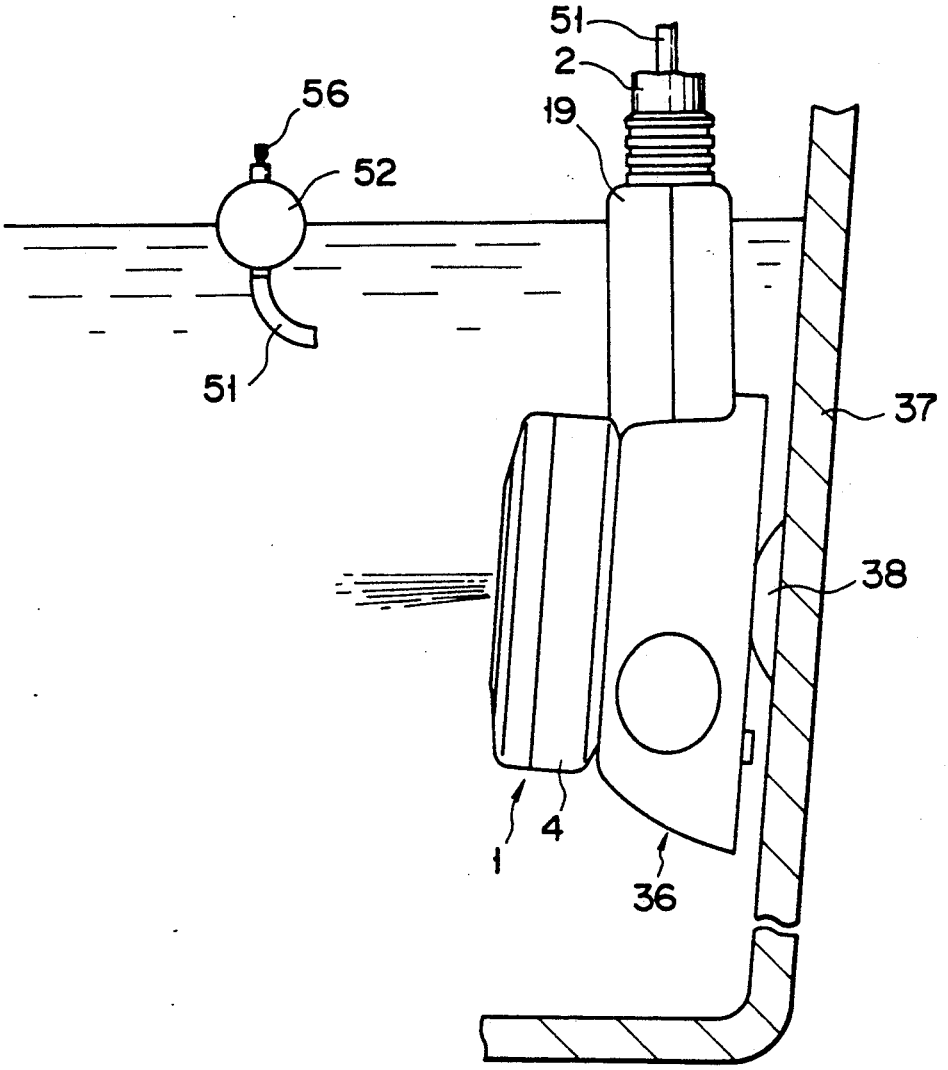
Figure 14:
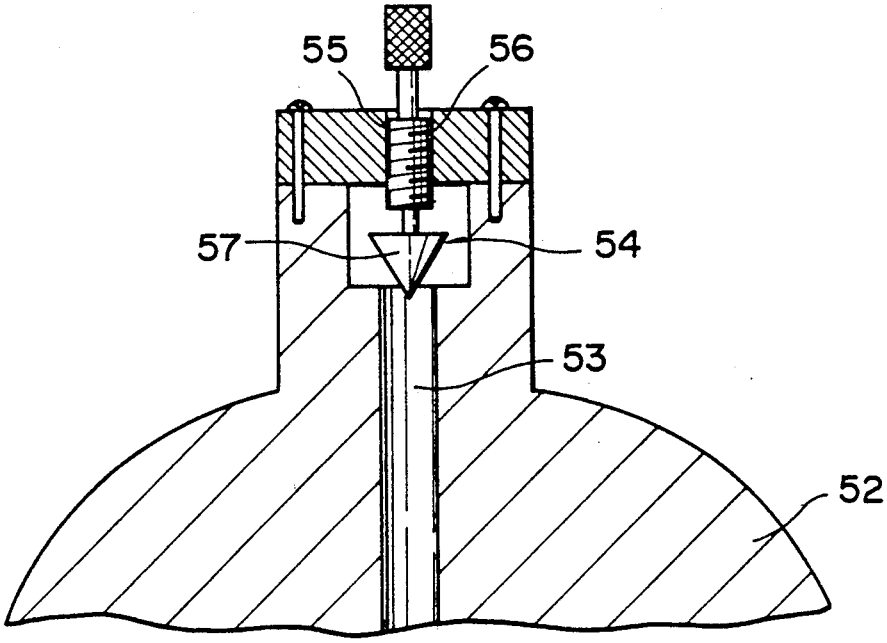

This embodiment is characterized in that supplementary air is supplied to a jet stream chamber 25 of a nozzle body 1. A first path and a second path 50 are formed in a nozzle case 4. The first path is used to introduce a fluid mixture of air and hot water from a jet hole 44 through a hose 2, whereas the second path 50 is used to introduce supplementary air into the jet stream chamber 25. One end of an air introducing hose 51 is connected to the inlet side of the second path 50. The other end of the hose 51 extends outside through a clamp portion 19 of the nozzle body 1. The end of this extended portion is connected to a float 52 floating on a hot water surface of a bath 37, as shown in FIG. 13. As shown in FIG. 14, an air introducing path 53 is formed inside the float 52. The path 53 is used to take air from a bathroom and introduce it to the hose 51.

When the hose 2 is connected to the jet hole 44 in the bath inner wall and a fluid mixture is introduced to the nozzle body 1, air bubbles in the fluid mixture may vanish and a jet pressure may be decreased. In this embodiment, however, since air is introduced from the float 52 to the jet stream chamber 25, the air is drawn into the jet stream chamber 25 due to an ejector effect, and is mixed with hot water therein. As a result, the air can be forcibly blown from the jet hole 26 into the bath.

In this embodiment, an air amount adjusting means 54 for adjusting the amount of this supplementary air is formed at the upper end of the float 52. The adjusting means 54 comprises a screw hole 55 formed in the upper end of the float 52, a rotary shaft 56 which is threadably engaged with the screw hole 55 so as to be reciprocated, and a conical air valve 57 attached to the distal end of the rotary shaft 56. As the rotary shaft 56 threadably advances, the air valve 57 gradually closes the inlet of the air introducing path 53 so as to decrease the amount of air to be introduced. As the rotary shaft 56 rotates to move backward, the air valve 57 gradually opens the inlet of the path 53. By rotating the rotary shaft 56 in a desired direction so as to change the inlet path sectional area of the path 53 in this manner, the amount of supplementary air to be supplied to a jet stream can be arbitrarily adjusted. Along with this operation, the jet pressure of a jet stream jetting into the bath can be changed.

Figure 15:
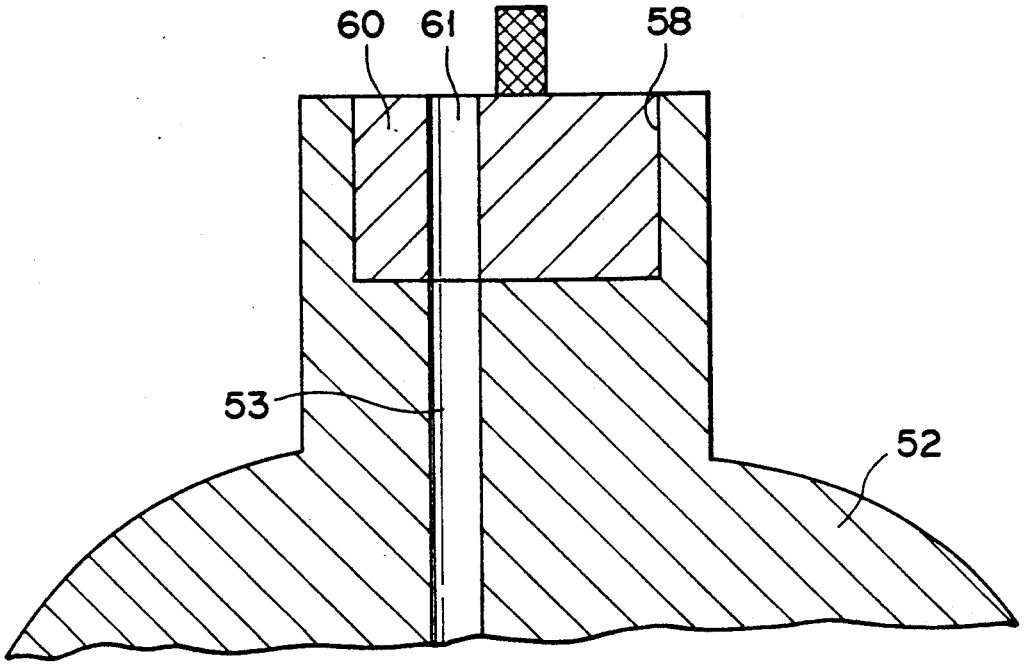
Figure 16:
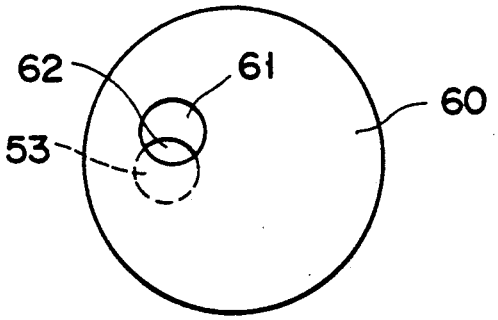

The arrangement of the air amount adjusting means 54 is not necessarily limited to the one shown in FIG. 14, but various arrangements can be employed. For example, as shown in FIG. 15, a shaft hole 58 is formed in the upper end of a float 52, and a rotary member 60 is fitted in the hold 58 so as not to be easily removed. An air hold 61 is formed in the rotary member 60 at a position radially deviated from its center. With this arrangement, the amount of air to be introduced can be adjusted by changing an area 62 where the air hold 61 overlaps an air introducing path 53, as shown in FIG. 16.

The float 52 is allowed to float in a corner of a bath, i.e., a so-called dead zone. Therefore, when jet massage is to be performed, a user can comfortably enjoy massage in the bath without being bothered by the float.

The present invention is not limited to the above-described embodiments, but various changes and modifications can be made. For example, the shower jet holes 32 may be omitted from the nozzle body 1, and only a jet stream may be jetted out. In addition, the impeller 17 may be omitted, and continuous shower streams may be obtained instead of the above-described intermittent shower jet streams.

Furthermore, the flow 52 may be omitted, and the distal end of the air introducing hose 51 may be fixed on a bath room wall or the like so that air can be directly taken from the distal end of the hose 51. Alternatively, air may be mixed with hot water and jetted out from a jet hole for compressed hot water by utilizing the same ejector effect as that of a nozzle. In this system, therefore, air is not mixed with hot water in the nozzle.

What is claimed is:

1. A jet nozzle apparatus comprising:

(a) a hose connectable with a compressed hot water jet hole formed inside a bath;

(b) nozzle means including:

at least a jet hole means for forcible jetting hot water which is supplied through the hose;

a plurality of shower hole means, each having a diameter smaller than the diameter of the jet hole means, for loosely sprinkling the hot water, the shower hole means being arranged so as to surround the jet hole means;

hot water flow path means for connecting the hose with the jet and shower hole means; and air introducing hole means for supplying air to the hot water immediately before the hot water is jetted from the jet hole means;

(c) change-over means for switching the hot water flow through the path means from the hose to the jet and shower hole means; and (d) an air introducing hose, connected to the air introducing hole means of said nozzle means, for supplying air to the air introducing hole means.

2. A jet nozzle apparatus comprising:

(a) jet nozzle means having a water inlet end and a water outlet end, and including;

jet means defining at least one jet hole at said water outlet end for discharging a jet stream of water;

means defining a plurality of shower holes in surrounding relationship to said jet hole at said water outlet end of said jet means, each said shower hole for forming a respective number of shower streams;

means defining a flow path for establishing fluid communication between said water inlet end and each of said jet means and said plurality of shower holes; and change-over means for selectively switching the water entering said jet nozzle means at said water inlet end to one of said jet hole and said plurality of said shower holes to respectively cause one of said jet stream of pressurized water and said shower streams to be discharged from said outlet end of said jet nozzle means, respectively; and (b) a hose having one end connected to said water inlet end of said jet nozzle, and an opposite end adapted to being coupled operatively to a jet hole defined in a wall of a bath fixture through which a stream of pressurized water is discharged, said hose for transferring said pressurized stream of water from said jet hole to said inlet end of said jet nozzle; and (c) aspirating means defining an air-introduction path for introducing air into said flow path upstream of said jet means, whereby said introduced air is mixed with said jet stream of water when discharged from said jet means.

3. A water jet-massage/shower apparatus adapted to being coupled operatively to a jet hole formed in a wall of a bath fixture from which pressurized water is discharged, comprising:

a body member having a water inlet end and a water outlet end;

a hose member having one end connected to said water inlet end of said body member and an opposite end which includes a connecting means for connecting said hose member in operative association with said jet hole of said bath fixture;

said body member defining at said outlet end thereof a number of shower apertures for discharging water from said body member in a corresponding number of shower streams;

a jet nozzle positioned at said outlet end of said body member for forming a jet stream of water;

said body member including a first flow path which establishes fluid communication between said inlet end and said jet nozzle, and a second flow path which establishes fluid communication between said inlet end and said number of shower apertures;

valve means associated with said body member and having first and second operative positions for respectively selectively changing flow of water within said body member between said first and second operative positions for respectively selectively changing flow of water within said body member between said first and second flow so as to respectively selectively cause said pressurized jet stream and said corresponding number of shower streams to be discharged from said outlet end of said body member, and aspirating means defining an air-introduction path for introducing air downstream of said valve means into said first flow path for defined within said body member, whereby said introduced air is mixed with said pressurized jet stream and discharged from said body member.

4. A water jet-massage/shower apparatus adapted to being coupled operatively to a jet hole formed in a wall of a bath fixture from which pressurized water is discharged, comprising:

a body member having a water inlet end and a water outlet end;

a hose member having one end connected to said water inlet end of said body member and an opposite end which includes a connecting means for connecting said hose member in operative association with said jet hole of said bath fixture;

said body member defining at said outlet end thereof a number of shower apertures for discharging water from said body member in a corresponding number of shower streams;

a jet nozzle positioned at said outlet end of said body member for forming a jet stream of water;

said body member including a first flow path which established fluid communication between said inlet end and said jet nozzle, and a second flow path which establishes fluid communication between said inlet end and said number of shower apertures;

valve means associated with said body member and having first and second operative positions for respectively selectively changing flow of water within said body member between said first and second operative positions for respectively selectively changing flow of water within said body member between said first and second flow paths so as to respectively selectively cause said pressurized jet stream and said corresponding number of shower streams to be discharged from said outlet end of said body member, wherein said connecting means includes suction cup means for removably coupling said opposite end of said hose member operatively to said jet hole of said bath fixture.

5. An apparatus as in claim 4, wherein said suction cup means includes a grip portion for allowing a suction force of said suction means to be manually released.

6. An apparatus as in claim 4, wherein said connecting means an insertion member sized and configured to be inserted within said jet hole of said bath fixture, and wherein said suction cup means is in surrounding relationship to said insertion member.

7. An apparatus as in claim 6, wherein said insertion member includes a corrugated wall portion.

8. A water jet-massage/shower apparatus adapted to being coupled operatively to a jet hole formed in a wall of a bath fixture from which pressurized water is discharged, comprising:

a body member having a water inlet end and a water outlet end;

a hose member having one end connected to said water inlet end of said body member and an opposite end which includes a connecting means for connecting said hose member in operative association with said jet hole of said bath fixture;

said body member defining at said outlet end thereof a number of shower apertures for discharging water from said body member in a corresponding number of shower streams;

a jet nozzle positioned at said outlet end of said body member for forming a jet stream of water;

said body member including a first flow path which established fluid communication between said inlet end and said jet nozzle, and a second flow path which establishes fluid communication between said inlet end and said number of shower apertures;

valve means associated with said body member and having first and second operative positions for respectively selectively changing flow of water within said body member between said first and second operative positions for respectively selectively changing flow of water within said body member between said first and second flow paths so as to respectively selectively cause said pressurized jet stream and said corresponding number of shower streams to be discharged from said outlet end of said body member, wherein said connecting means includes a generally cylindrical insertion member sized and configured to be inserted within said jet hole of said bath fixture, said insertion member including a corrugated wall section.

* * * * *